US012022885B2

(12) United States Patent
Yang et al.

(10) Patent No.: US 12,022,885 B2
(45) Date of Patent: Jul. 2, 2024

(54) ATOMIZER CONTROL CIRCUIT AND ELECTRONIC CIGARETTE

(71) Applicant: Shenzhen Zun Yi Pin Technology Co., Ltd., Shenzhen (CN)

(72) Inventors: Miaowen Yang, Shenzhen (CN); Yonghui Lin, Shenzhen (CN); Shimei Pan, Shenzhen (CN); Huifu Shuai, Shenzhen (CN); Yongjun Guo, Shenzhen (CN); Yongjie Mo, Shenzhen (CN)

(73) Assignee: Shenzhen Zun Yi Pin Technology Co., Ltd., Shenzhen (CN)

( * ) Notice: Subject to any disclaimer, the term of this patent is extended or adjusted under 35 U.S.C. 154(b) by 190 days.

(21) Appl. No.: 17/711,554

(22) Filed: Apr. 1, 2022

(65) Prior Publication Data

US 2023/0144127 A1 May 11, 2023

(30) Foreign Application Priority Data

Nov. 8, 2021 (CN) ..... 202122714255.2

(51) Int. Cl.
*A24F 40/10* (2020.01)
*A24F 40/30* (2020.01)
(Continued)

(52) U.S. Cl.
CPC ..... *A24F 40/60* (2020.01); *A24F 40/30* (2020.01); *A24F 40/53* (2020.01)

(58) Field of Classification Search
None
See application file for complete search history.

(56) References Cited

U.S. PATENT DOCUMENTS

2016/0338407 A1 11/2016 Kerdemelidis
2017/0049155 A1* 2/2017 Liu ..... H05B 1/0244
(Continued)

FOREIGN PATENT DOCUMENTS

CN 103783673 A 5/2014
CN 105077591 A 11/2015
(Continued)

OTHER PUBLICATIONS

CN-111227319-A English Translation obtained from Espacenet, pp. 1-12 (Year: 2020).*
(Continued)

*Primary Examiner* — Philip Y Louie
*Assistant Examiner* — Madeleine P Delacruz
(74) *Attorney, Agent, or Firm* — Daylight Law, P.C.

(57) ABSTRACT

An atomizer control circuit and an electronic cigarette are disclosed. The atomizer control circuit includes a first atomization module, a second atomization module, a detection module, a main control module, and a touch module. The first atomization module is configured to control a first atomizer. The second atomization module is configured to control a second atomizer. The detection module is configured to turn on the first atomizer or the second atomizer according to an operation action of a user and output a turn-on signal. The main control module is configured to output a detection signal according to the turn-on signal. The detection module is further configured to detect the first atomizer or the second atomizer according to the detection signal. The touch module is configured to generate a trigger signal.

11 Claims, 4 Drawing Sheets

(51) Int. Cl.

| | |
|---|---|
| ***A24F 40/50*** | (2020.01) |
| ***A24F 40/53*** | (2020.01) |
| ***A24F 40/60*** | (2020.01) |

(56) References Cited

U.S. PATENT DOCUMENTS

| | | | | |
|---|---|---|---|---|
| 2017/0250552 | A1* | 8/2017 | Liu | H01M 10/46 |
| 2021/0401044 | A1* | 12/2021 | Qiu | A24F 40/485 |

FOREIGN PATENT DOCUMENTS

| | | | | | |
|---|---|---|---|---|---|
| CN | 206978742 | U | | 2/2018 | |
| CN | 109567280 | A | | 4/2019 | |
| CN | 111227319 | A | * | 6/2020 | |
| WO | WO-2015165146 | A1 | * | 11/2015 | A24F 47/00 |
| WO | WO-2020107394 | A1 | * | 6/2020 | A24F 40/51 |

OTHER PUBLICATIONS

WO-2020107394-A1 English Translation obtained from Espacenet, pp. 1-14 (Year: 2020).*

WO-2015165146-A1 English Translation obtained from Espacenet, pp. 1-24 (Year: 2015).*

International Search Report from International Application No. PCT/CN2021/134592 dated Apr. 25, 2022.

Written Opinion from International Application No. PCT/CN2021/134592 dated Apr. 25, 2022.

* cited by examiner

ATOMIZER CONTROL CIRCUIT AND ELECTRONIC CIGARETTE

CROSS-REFERENCE TO RELATED APPLICATION

This application claims priority to Chinese patent application No. 202122714255.2 filed Nov. 8, 2021, which is incorporated by reference herein in its entirety for all purposes.

BACKGROUND

In existing technology, during the use of some dual-flavor electronic cigarettes, flavors are changed by removing and inserting atomizers. This manner may cause inconvenience in actual use, and frequent replacement of parts tends to cause damage to the parts, to further affect the service life of products.

SUMMARY

The present disclosure relates to the field of electronic cigarettes, and more particularly, to an atomizer control circuit and an electronic cigarette.

The present disclosure resolves at least one of the technical problems in the existing technology. For this, the present disclosure provides an atomizer control circuit, which controls different atomizers to perform atomization through touching of a trigger key, so as to avoid damage to parts due to repeated removal and insertion of the parts.

The present disclosure further provides an electronic cigarette having the foregoing atomizer control circuit.

An atomizer control circuit according to an embodiment of a first aspect of the present disclosure includes: a first atomization module, configured to control a first atomizer; a second atomization module, configured to control a second atomizer; a detection module, configured to turn on the first atomizer or the second atomizer according to an operation action of a user, and output a turn-on signal; a main control module, separately connected to the detection module, the first atomization module, and the second atomization module, and configured to obtain the turn-on signal, and output a detection signal according to the turn-on signal, where the detection module is further configured to detect the first atomizer or the second atomizer according to the detection signal; and a touch module, connected to the main control module, and configured to generate a trigger signal, where the main control module is further configured to, if it is detected that the first atomizer or the second atomizer is normal, control the first atomization module or the second atomization module to operate according to the trigger signal.

The atomizer control circuit according to the embodiment of the present disclosure at least has the following beneficial effects. Two atomizers are disposed, and different atomization modules are selected to operate according to an operation action of a user to make different atomizers perform atomization, thus avoiding damage to parts due to repeated removal and insertion of the parts.

According to some embodiments of the present disclosure, the turn-on signal includes a first connection signal and a second connection signal, and the detection signal includes a first test signal and a second test signal.

The detection module is further configured to turn on the first atomizer according to the operation action of the user, and output the first connection signal. The main control module is further configured to obtain the first connection signal, and output the first test signal according to the first connection signal. The detection module is further configured to detect the first atomizer according to the first test signal. The main control module is further configured to, if it is detected that the first atomizer is normal, control the first atomization module to operate according to the trigger signal. Alternatively, the detection module is further configured to turn on the second atomizer according to the operation action of the user, and output the second connection signal. The main control module is further configured to obtain the second connection signal, and output the second test signal according to the second connection signal. The detection module is further configured to detect the second atomizer according to the second test signal. The main control module is further configured to, if it is detected that the second atomizer is normal, control the second atomization module to operate according to the trigger signal.

According to some embodiments of the present disclosure, the touch module includes a first resistor and a touch key. The touch key includes a power terminal, a ground terminal, and a touch signal output terminal. One end of the first resistor is connected to the power terminal, and the other end of the first resistor is connected to a power supply. The ground terminal is grounded. The touch signal output terminal is connected to the main control module.

According to some embodiments of the present disclosure, the main control module includes a main control chip which is connected to the detection module, the touch module, the first atomization module, and the second atomization module, respectively.

According to some embodiments of the present disclosure, the detection module includes a first detection unit and a second detection unit. The first detection unit is configured to turn on the first atomizer according to the operation action of the user, and output the first connection signal. The first detection unit is further configured to detect the first atomizer according to the first test signal.

The second detection unit is configured to turn on the second atomizer according to the operation action of the user, and output the second connection signal. The second detection unit is further configured to detect the second atomizer according to the second test signal.

According to some embodiments of the present disclosure, the first detection unit includes a second resistor, a third resistor, a fourth resistor, a fifth resistor, a sixth resistor, a seventh resistor, an eighth resistor, and a bipolar junction transistor.

One end of the second resistor is connected to a base of the bipolar junction transistor, and the other end of the second resistor is connected to the main control chip and is configured to obtain the first test signal. One end of the third resistor is connected to the base of the bipolar junction transistor, and the other end of the third resistor is connected to an emitter of the bipolar junction transistor. One end of the fourth resistor is connected to a collector of the bipolar junction transistor, the other end of the fourth resistor is connected to one end of the fifth resistor and is configured to turn on the first atomizer according to the operation action of the user, and the other end of the fifth resistor is connected to a power supply. One end of the sixth resistor is connected to the other end of the fourth resistor, the other end of the sixth resistor is connected to the main control chip, and the other end of the sixth resistor is configured to output the first connection signal to the main control chip. One end of the seventh resistor is connected to the collector of the bipolar junction transistor, and the other end of the seventh resistor is connected to the main control chip. One end of the eighth resistor is connected to the other end of the fourth resistor, and the other end of the eighth resistor is connected to the main control chip.

According to some embodiments of the present disclosure, the first atomization module includes a ninth resistor and a field effect transistor. One end of the ninth resistor is connected to a source of the field effect transistor, and the other end of the ninth resistor is connected to a gate of the field effect transistor. A drain of the field effect transistor is connected to the first atomizer, and the gate of the field effect transistor is connected to the main control chip.

According to some embodiments of the present disclosure, the main control chip is configured to, when the first atomizer is normal, control the field effect transistor according to the trigger signal to be turned on.

According to some embodiments of the present disclosure, the touch key is further configured to generate a power on-off signal according to multiple consecutive touches of the user, and the main control module is further configured to perform child lock power off or on according to the power on-off signal.

The electronic cigarette according to an embodiment of a second aspect of the present disclosure includes the foregoing atomizer control circuit in the foregoing embodiment of the first aspect.

Additional aspects and advantages of the present disclosure are provided in the following description. Further additional aspects and advantages of the present disclosure will be understood and become obvious to those of ordinary skill in the art upon obtaining an understanding of the present disclosure or through the practice of the present disclosure.

BRIEF DESCRIPTION OF DRAWINGS

The present disclosure is further described below with reference to the accompanying drawings and embodiments.

Figure 1:
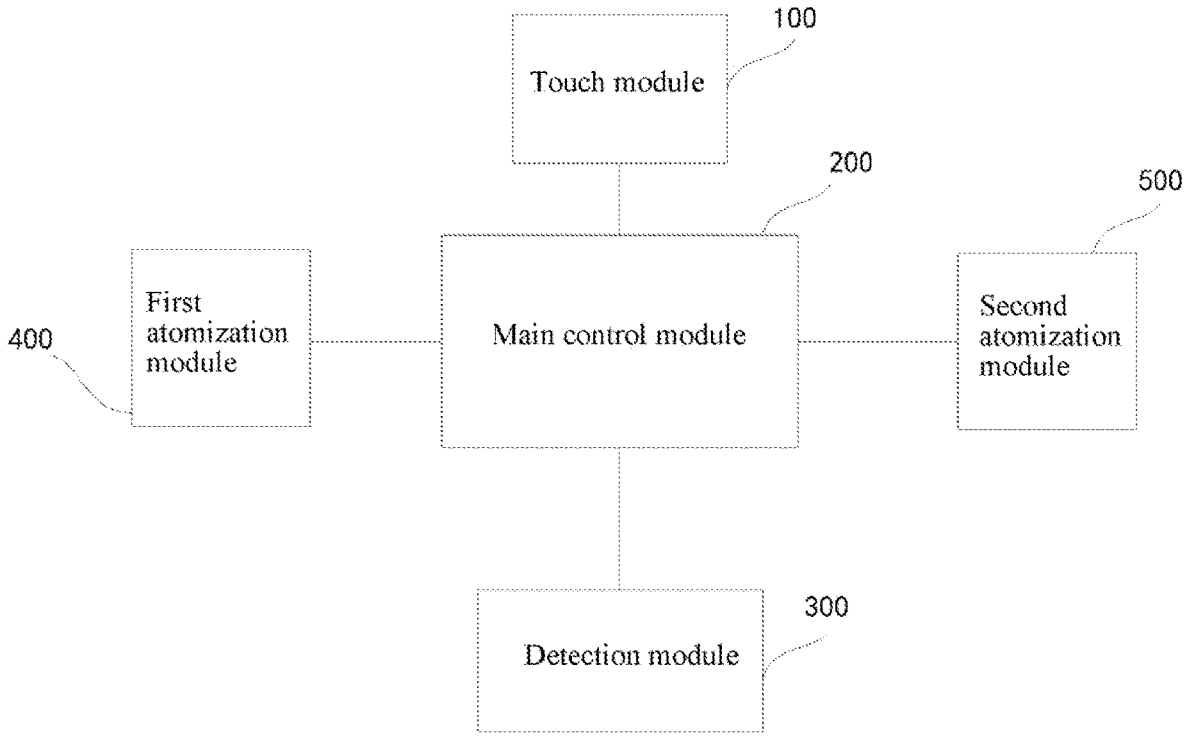
FIG. 1 is a module diagram of an embodiment of an atomizer control circuit according to the present disclosure.

The following elements correspond to the following reference numerals as listed: touch module 100, touch key 110, main control module 200, detection module 300, first detection unit 310, second detection unit 320, first atomization module 400, and second atomization module 500.

DETAILED DESCRIPTION

Embodiments of the present disclosure are described below in detail. Examples of the embodiments are shown in the accompanying drawings. The same or similar numerals represent the same or similar elements or elements having the same or similar functions throughout the specification. The embodiments described below with reference to the accompanying drawings are exemplary, and are only used to explain the present disclosure but should not be construed as a limitation to the present disclosure.

In the description of the present disclosure, "several" means more than one, "a plurality of" means more, "greater than a number", "less than a number", "exceed a number" and the like indicate that the number is excluded, and "above a number", "below a number", "within a number", and the like indicate that the number is included. "First", "second", and the like described herein are used only for distinguishing the technical feature, but are not intended to indicate or imply relative importance or implicitly specify a quantity of indicated technical features or implicitly specify an order of indicated technical features.

In the description of the present disclosure, unless otherwise expressly defined, the terms such as "disposed", "mounted", and "connected" should be understood in a broad sense. For persons of ordinary skill in the art, specific meanings of the terms in the present disclosure may be appropriately determined with reference to the specific content in the technical solution.

In some embodiments, referring to FIG. 1, an atomizer control circuit includes a first atomization module 400, a second atomization module 500, a detection module 300, a main control module 200, and a touch module 100. The first atomization module 400 is configured to control a first atomizer. The second atomization module 500 is configured to control a second atomizer. The detection module 300 is configured to turn on the first atomizer or the second atomizer according to an operation action of a user, and output a turn-on signal. The main control module 200 is connected to the detection module 300, the first atomization module 400, and the second atomization module 500, respectively. The main control module 200 is configured to obtain the turn-on signal, and output a detection signal according to the turn-on signal. The detection module 300 is further configured to detect the first atomizer or the second atomizer according to the detection signal. The touch module 100 is connected to the main control module 200. The touch module 100 is configured to generate a trigger signal. The main control module 200 is further configured to, if it is detected that the first atomizer or the second atomizer is normal, control the first atomization module 400 or the second atomization module 500 to operate according to the trigger signal.

The atomizer control circuit in the embodiment of the present disclosure at least has the following beneficial effects. Two atomizers are disposed, and different atomization modules are selected to operate according to an operation action of a user to make different atomizers perform atomization, thus avoiding damage to parts due to repeated removal and insertion of the parts.

In some embodiments, when the atomizer control circuit of the present disclosure is applied to a dual-flavor electronic cigarette, the operation action of selecting different atomization modules to operate by the user may be rotating a top cap of a mouthpiece of the electronic cigarette to connect the mouthpiece to different e-liquid chambers or may be toggling a switch to select different atomization modules. Only one atomization module operates at one moment.

In some embodiments, the turn-on signal includes a first connection signal and a second connection signal, and the detection signal includes a first test signal and a second test signal.

The detection module 300 is further configured to turn on the first atomizer according to the operation action of the user, and output the first connection signal. The main control module 200 is further configured to obtain the first connection signal, and output the first test signal according to the first connection signal. The detection module 300 is further configured to detect the first atomizer according to the first test signal. The main control module 200 is further configured to, if it is detected that the first atomizer is normal, control the first atomization module 400 to operate according to the trigger signal.

Alternatively, the detection module 300 is further configured to turn on the second atomizer according to the operation action of the user, and output the second connection signal. The main control module 200 is further configured to obtain the second connection signal, and output the second test signal according to the second connection signal. The detection module 300 is further configured to detect the second atomizer according to the second test signal. The main control module 200 is further configured to, if it is detected that the second atomizer is normal, control the second atomization module 500 to operate according to the trigger signal.

Figure 2:
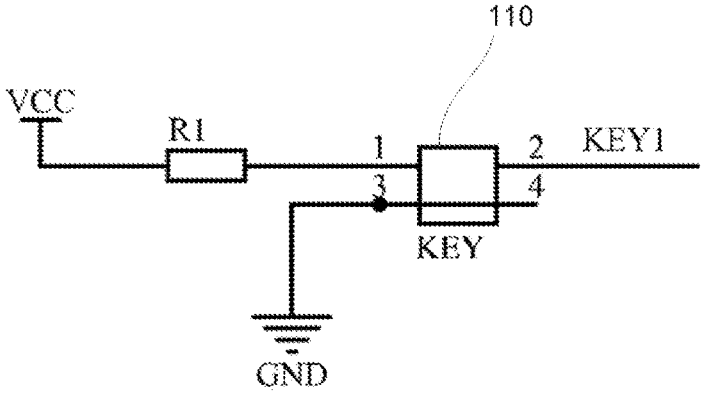
FIG. 2 is a circuit diagram of an embodiment of a touch module in FIG. 1.

In some embodiments, referring to FIG. 2, the touch module 100 includes a first resistor R1 and a touch key 110. The touch key 110 includes a power terminal (No. 1 pin), a ground terminal (No. 3 pin), and a touch signal output terminal (No. 2 pin). One end of the first resistor R1 is connected to the power terminal. The other end of the first resistor R1 is connected to a power supply. The ground terminal is grounded. The touch signal output terminal is connected to the main control module 200. In some examples, the touch key 110 may be replaced with a mechanical button. The trigger signal is sent to the main control module 200 by pressing the mechanical button.

Figure 3:
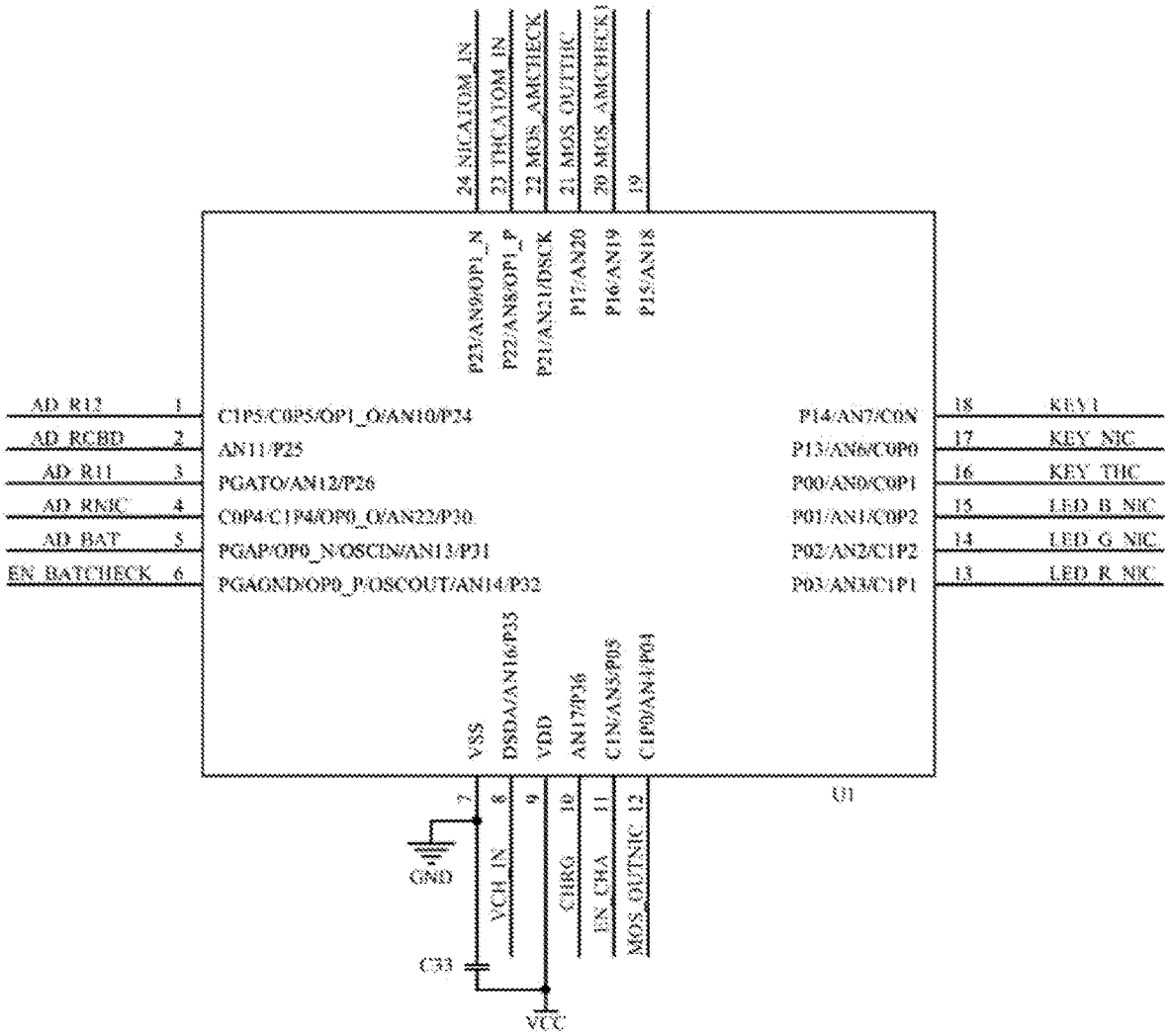
FIG. 3 is a circuit diagram of an embodiment of a main control module in FIG. 1.

In some embodiments, referring to FIG. 3, the main control module 200 includes a main control chip U1. The main control chip U1 is connected to the detection module 300, the touch module 100, the first atomization module 400, and the second atomization module 500, respectively. The selection of the main control chip U1 is determined by the user in conjunction with a specific use scenario.

Figure 4:
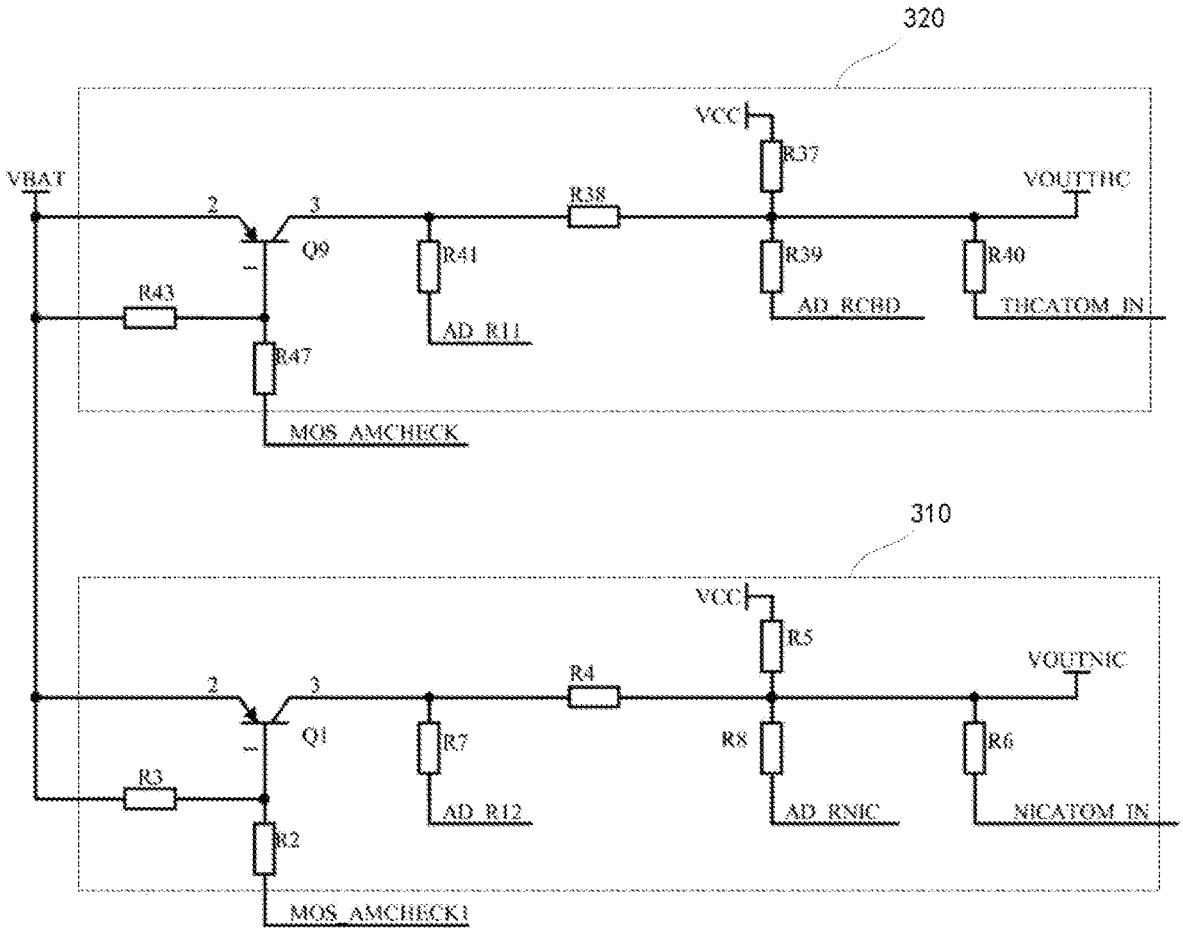
FIG. 4 is a circuit diagram of an embodiment of a detection module in FIG. 1.

In some embodiments, referring to FIG. 4, the detection module 300 includes a first detection unit 310 and a second detection unit 320. The first detection unit 310 is configured to turn on the first atomizer according to the operation action of the user, and output the first connection signal. The first detection unit 310 is further configured to detect the first atomizer according to the first test signal.

The second detection unit 320 is configured to turn on the second atomizer according to the operation action of the user, and output the second connection signal. The second detection unit 320 is further configured to detect the second atomizer according to the second test signal.

A quantity of the detection units is the same as a quantity of the atomization modules, and corresponds to a quantity of atomizers. For example, when more than three atomizers need to be controlled, the quantity of the detection units and the quantity of the atomization modules may also be greater than 3, and are the same as the quantity of the atomizers.

In some embodiments, referring to FIG. 4, the first detection unit 310 includes a second resistor R2, a third resistor R3, a fourth resistor R4, a fifth resistor R5, a sixth resistor R6, a seventh resistor R7, an eighth resistor R8, and a bipolar junction transistor Q1.

One end of the second resistor R2 is connected to a base of the bipolar junction transistor Q1. The other end of the second resistor R2 is connected to the main control chip U1 and is configured to obtain the first test signal. One end of the third resistor R3 is connected to the base of the bipolar junction transistor Q1, and the other end of the third resistor R3 is connected to an emitter of the bipolar junction transistor Q1. One end of the fourth resistor R4 is connected to a collector of the bipolar junction transistor Q1. The other end of the fourth resistor R4 is connected to one end of the fifth resistor R5 and is configured to turn on the first atomizer according to the operation action of the user. The other end of the fifth resistor R5 is connected to a power supply. One end of the sixth resistor R6 is connected to the other end of the fourth resistor R4. The other end of the sixth resistor R6 is connected to the main control chip U1 and is configured to output the first connection signal to the main control chip U1. One end of the seventh resistor R7 is connected to the collector of the bipolar junction transistor Q1, and the other end of the seventh resistor R7 is connected to the main control chip U1. One end of the eighth resistor R8 is connected to the other end of the fourth resistor R4, and the other end of the eighth resistor R8 is connected to the main control chip U1.

In an example, the atomizer includes a heating wire, and therefore may be considered as a resistive load. When the first detection unit 310 turns on the first atomizer, there is a change in a value of a voltage across two ends of the sixth resistor R6, which is equivalent to the sixth resistor R6 outputting a voltage signal to the main control chip U1. The signal is the first connection signal. After receiving the first connection signal, the main control module 200 changes a voltage at a pin connected to the second resistor R2 to turn on the bipolar junction transistor Q1, which is equivalent to outputting a voltage signal for turning on the bipolar junction transistor Q1. The signal is the first test signal. After the bipolar junction transistor Q1 is turned on, in the atomizer control circuit, it may be considered that the atomizer is connected to a battery power source by the fourth resistor R4, and the seventh resistor R7 and the eighth resistor R8 are respectively connected to two ends of the fourth resistor R4. Therefore, the main control chip U1 may obtain a difference between voltages at the two ends of the fourth resistor R4 through the seventh resistor R7 and the eighth resistor R8 in this case, and determines, according to a voltage division principle of a resistor and an internal determination program, that the first atomizer is in a normal, damaged or burnt down state.

Referring to FIG. 4, the circuit structure and working principle of the second detection unit 320 are the same as those of the first detection unit 310. Details are not described again herein as the following pairs of elements conduct the same action in the two separate detection units (e.g., first detection unit 310 and second detection unit 320): Q1 and Q9; R3 and R43; R2 and R27; R7 and R41; R4 and R38; R5 and R37; R8 and R39; and R6 and R40. Only one atomizer is connected to the detection module 300 at one moment.

In an example, when the quantity of the detection units is 3, the circuit structure and working principle of the third detection unit are also the same as those of the first detection unit 310.

Figure 5:
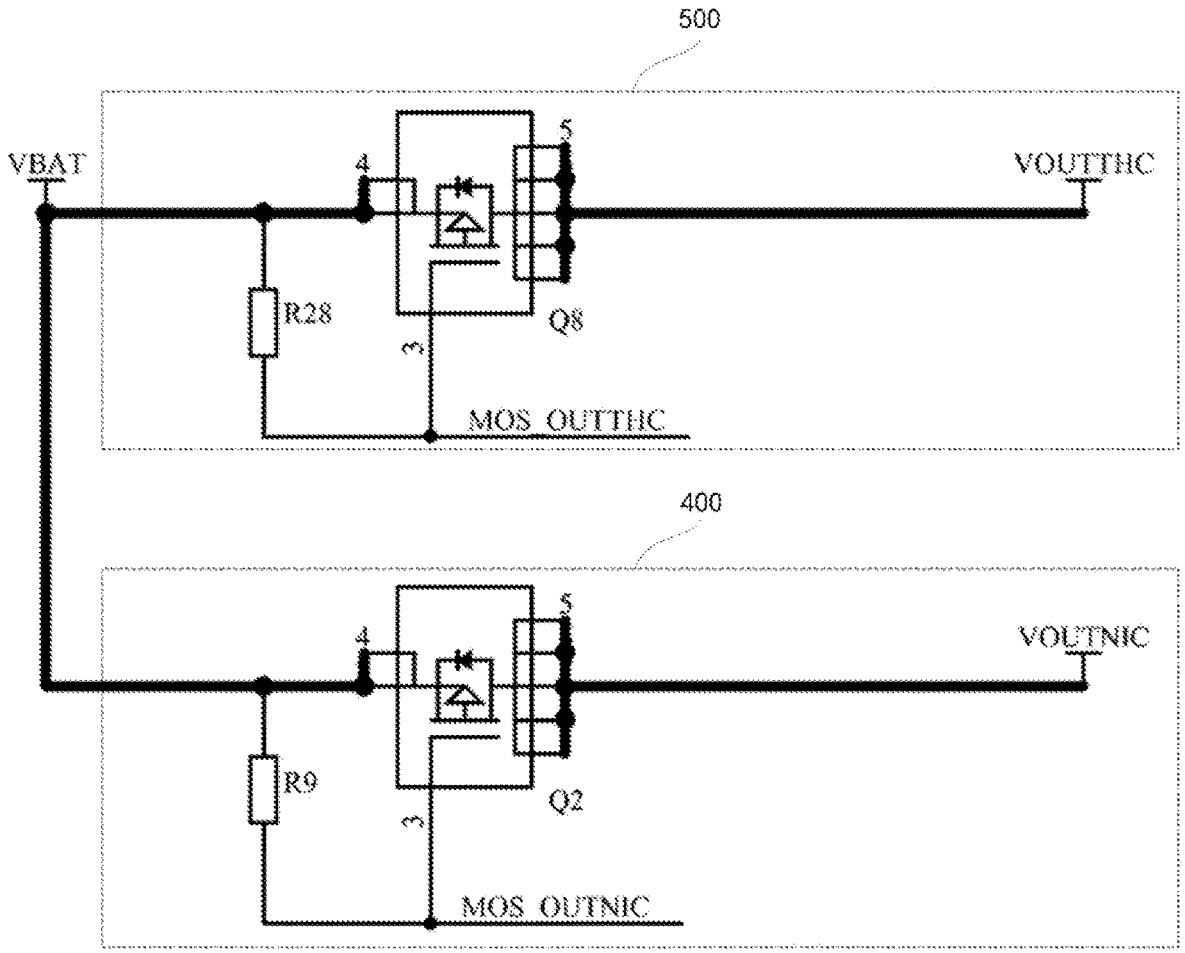
FIG. 5 is a circuit diagram of an embodiment of a first atomization module and a second atomization module in FIG. 1.

In some embodiments, referring to FIG. 5, the first atomization module 400 includes a ninth resistor R9 and a field effect transistor Q2. One end of the ninth resistor R9 is connected to a source of the field effect transistor Q2, and the other end of the ninth resistor R9 is connected to a gate of the field effect transistor Q2. A drain of the field effect transistor Q2 is connected to the first atomizer, and the gate of the field effect transistor Q2 is connected to the main control chip U1.

In some embodiments, the main control chip U1 is configured to, when the first atomizer is normal, control the field effect transistor Q2 to be turned on according to the trigger signal. When it is detected that the first atomizer is normal, the main control chip U1 changes a voltage at a pin connected to the gate of the field effect transistor Q2 according to the trigger signal generated when the user presses the touch key 110, to turn on the field effect transistor Q2. In this case, this is equivalent to the first atomizer being directly connected to a battery power source. A battery directly supplies power to the first atomizer, to make the first atomizer perform an atomization operation.

Referring to FIG. 5, the circuit structure and working principle of the second atomization module 500 are the same as those of the first atomization module 400. Details are not described again herein as the following pairs of elements conduct the same action in the two separate atomization modules (e.g., first atomization module 400 and second atomization module 500): Q2 and Q8; and R9 and R28. It needs to be noted that only one atomizer is connected to the battery power source at one moment.

In some embodiments, the touch key 110 is further configured to generate a power on-off signal according to multiple consecutive touches of the user. The main control module 200 is further configured to perform child lock power off or on according to the power on-off signal. The circuit may be controlled to be turned on or off by touching the touch key 110 a plurality of times. The specific number of touches is customized by the user.

In an example, when the atomizer control circuit of the present disclosure is applied to an electronic cigarette, if it is set that the power on-off signal is generated when the touch key 110 is continuously touched five times, the electronic cigarette can be powered on or off by continuously touching the touch key five times. In this way, power on or off caused by a mistouch can be avoided, and a child can be prevented from accidentally using an electronic cigarette product.

In some embodiments, the electronic cigarette includes the foregoing atomizer control circuit in the foregoing embodiment.

The electronic cigarette according to the embodiment of the present disclosure at least has the following beneficial effects. Different atomization modules are selected to operate according to an operation action of a user, and a trigger key is touched to control different atomizers to perform atomization, so that damage to parts due to repeated removal and insertion of the parts is avoided, and different e-liquid flavors can be conveniently switched. In addition, a child lock power on and off function is provided, so that power on or off caused by a mistouch can be avoided, and a child can be prevented from accidentally using the electronic cigarette.

In the description of the present disclosure, the description with reference to terms "an embodiment", "some embodiments", "exemplary embodiments", "an example", "a specific example" or "some embodiments", and the like indicate that specific features, structures, materials or characteristics described with reference to the embodiments or examples are included in at least one embodiment or example of this application. In the specification, the schematic descriptions of the foregoing terms do not necessarily involve the same embodiments or examples. In addition, the described specific features, structures, materials or characteristics may be combined in an appropriate manner in any one or more embodiments or examples.

The embodiments of the present disclosure are described above in detail with reference to the accompanying drawings. However, the present disclosure is not limited to the foregoing embodiments. Within the knowledge of a person of ordinary skilled in the art, various changes may further be made without departing from the spirit of the present disclosure. In addition, the embodiments in the present disclosure and the features in the embodiments may be combined with each other without causing any conflict.

What is claimed is:

1. An atomizer control circuit, comprising:

a first atomization module configured to control a first atomizer;

a second atomization module configured to control a second atomizer;

a detection module configured to turn on the first atomizer or the second atomizer according to an operation action of a user, and output a turn-on signal;

a main control module connected to the detection module, the first atomization module, and the second atomization module respectively, and configured to obtain the turn-on signal, and output a detection signal according to the turn-on signal, wherein the detection module is further configured to detect the first atomizer or the second atomizer according to the detection signal; and a touch module connected to the main control module, and configured to generate a trigger signal, wherein the main control module is further configured to, in response to detecting that the first atomizer or the second atomizer is normal, control the first atomization module or the second atomization module to operate according to the trigger signal;

wherein the turn-on signal comprises a first connection signal and a second connection signal, and the detection signal comprises a first test signal and a second test signal; and wherein at least one of:

the detection module is further configured to turn on the first atomizer according to the operation action of the user, and output the first connection signal; the main control module is further configured to obtain the first connection signal, and output the first test signal according to the first connection signal; the detection module is further configured to detect the first atomizer according to the first test signal; and the main control module is further configured to, in response to detecting that the first atomizer is normal, control the first atomization module to operate according to the trigger signal; and the detection module is further configured to turn on the second atomizer according to the operation action of the user, and output the second connection signal; the main control module is further configured to obtain the second connection signal, and output the second test signal according to the second connection signal; the detection module is further configured to detect the second atomizer according to the second test signal; and the main control module is further configured to, in response to detecting that the second atomizer is normal, control the second atomization module to operate according to the trigger signal;

wherein the main control module comprises a main control chip, and the main control chip is connected to the detection module, the touch module, the first atomization module, and the second atomization module, respectively;

wherein the first atomization module comprises a ninth resistor and a field effect transistor, one end of the ninth resistor is connected to a source of the field effect transistor, the other end of the ninth resistor is connected to a gate of the field effect transistor, a drain of the field effect transistor is connected to the first atomizer, and the gate of the field effect transistor is connected to the main control chip;

wherein the main control chip is configured to, when the first atomizer is normal, control the field effect transistor to be turned on according to the trigger signal.

2. The atomizer control circuit of claim 1, wherein the touch module comprises a first resistor and a touch key, the touch key comprises a power terminal, a ground terminal, and a touch signal output terminal, one end of the first resistor is connected to the power terminal, the other end of the first resistor is connected to a power supply, the ground terminal is grounded, and the touch signal output terminal is connected to the main control module.

3. The atomizer control circuit of claim 1, wherein the detection module comprises a first detection unit and a second detection unit, the first detection unit is configured to turn on the first atomizer according to the operation action of the user, and output the first connection signal, and the first detection unit is further configured to detect the first atomizer according to the first test signal; and the second detection unit is configured to turn on the second atomizer according to the operation action of the user, and output the second connection signal, and the second detection unit is further configured to detect the second atomizer according to the second test signal.

4. The atomizer control circuit of claim 3, wherein the first detection unit comprises a second resistor, a third resistor, a fourth resistor, a fifth resistor, a sixth resistor, a seventh resistor, an eighth resistor, and a bipolar junction transistor;

one end of the second resistor is connected to a base of the bipolar junction transistor, the other end of the second resistor is connected to the main control chip, and the other end of the second resistor configured to obtain the first test signal;

one end of the third resistor is connected to the base of the bipolar junction transistor, and the other end of the third resistor is connected to an emitter of the bipolar junction transistor;

one end of the fourth resistor is connected to a collector of the bipolar junction transistor, the other end of the fourth resistor is connected to one end of the fifth resistor, the other end of the fifth resistor is connected to a power supply, and the other end of the fourth resistor is configured to turn on the first atomizer according to the operation action of the user;

one end of the sixth resistor is connected to the other end of the fourth resistor, the other end of the sixth resistor is connected to the main control chip, and the other end of the sixth resistor configured to output the first connection signal to the main control chip; and one end of the seventh resistor is connected to the collector of the bipolar junction transistor, the other end of the seventh resistor is connected to the main control chip, one end of the eighth resistor is connected to the other end of the fourth resistor, and the other end of the eighth resistor is connected to the main control chip.

5. The atomizer control circuit of claim 2, wherein the touch key is further configured to generate a power on-off signal according to multiple consecutive touches of the user, and the main control module is further configured to perform child lock power off or on according to the power on-off signal.

6. An electronic cigarette, comprising an atomizer control circuit, which comprising:

a first atomization module configured to control a first atomizer;

a second atomization module configured to control a second atomizer;

a detection module configured to turn on the first atomizer or the second atomizer according to an operation action of a user, and output a turn-on signal;

a main control module connected to the detection module, the first atomization module, and the second atomization module respectively, and configured to obtain the turn-on signal, and output a detection signal according to the turn-on signal, wherein the detection module is further configured to detect the first atomizer or the second atomizer according to the detection signal; and a touch module connected to the main control module, and configured to generate a trigger signal, wherein the main control module is further configured to, in response to detecting that the first atomizer or the second atomizer is normal, control the first atomization module or the second atomization module to operate according to the trigger signal;

wherein the turn-on signal comprises a first connection signal and a second connection signal, and the detection signal comprises a first test signal and a second test signal; and wherein at least one of:

the detection module is further configured to turn on the first atomizer according to the operation action of the user, and output the first connection signal; the main control module is further configured to obtain the first connection signal, and output the first test signal according to the first connection signal; the detection module is further configured to detect the first atomizer according to the first test signal; and the main control module is further configured to, in response to detecting that the first atomizer is normal, control the first atomization module to operate according to the trigger signal; and the detection module is further configured to turn on the second atomizer according to the operation action of the user, and output the second connection signal; the main control module is further configured to obtain the second connection signal, and output the second test signal according to the second connection signal; the detection module is further configured to detect the second atomizer according to the second test signal; and the main control module is further configured to, in response to detecting that the second atomizer is normal, control the second atomization module to operate according to the trigger signal;

wherein the main control module comprises a main control chip, and the main control chip is connected to the detection module, the touch module, the first atomization module, and the second atomization module, respectively;

wherein the first atomization module comprises a ninth resistor and a field effect transistor, one end of the ninth resistor is connected to a source of the field effect transistor, the other end of the ninth resistor is connected to a gate of the field effect transistor, a drain of the field effect transistor is connected to the first atomizer, and the gate of the field effect transistor is connected to the main control chip;

wherein the main control chip is configured to, when the first atomizer is normal, control the field effect transistor to be turned on according to the trigger signal.

7. An atomizer control circuit, comprising:

a first atomization module configured to control a first atomizer;

a second atomization module configured to control a second atomizer;

a detection module configured to turn on the first atomizer or the second atomizer according to an operation action of a user, and output a turn-on signal;

a main control module connected to the detection module, the first atomization module, and the second atomization module respectively, and configured to obtain the turn-on signal, and output a detection signal according to the turn-on signal, wherein the detection module is further configured to detect the first atomizer or the second atomizer according to the detection signal; and a touch module connected to the main control module, and configured to generate a trigger signal, wherein the main control module is further configured to, in response to detecting that the first atomizer or the second atomizer is normal, control the first atomization module or the second atomization module to operate according to the trigger signal;

wherein the turn-on signal comprises a first connection signal and a second connection signal, and the detection signal comprises a first test signal and a second test signal; and wherein at least one of:

the detection module is further configured to turn on the first atomizer according to the operation action of the user, and output the first connection signal; the main control module is further configured to obtain the first connection signal, and output the first test signal according to the first connection signal; the detection module is further configured to detect the first atomizer according to the first test signal; and the main control module is further configured to, in response to detecting that the first atomizer is normal, control the first atomization module to operate according to the trigger signal; and the detection module is further configured to turn on the second atomizer according to the operation action of the user, and output the second connection signal; the main control module is further configured to obtain the second connection signal, and output the second test signal according to the second connection signal; the detection module is further configured to detect the second atomizer according to the second test signal; and the main control module is further configured to, in response to detecting that the second atomizer is normal, control the second atomization module to operate according to the trigger signal;

wherein the main control module comprises a main control chip, and the main control chip is connected to the detection module, the touch module, the first atomization module, and the second atomization module, respectively;

wherein the detection module comprises a first detection unit and a second detection unit, the first detection unit is configured to turn on the first atomizer according to the operation action of the user, and output the first connection signal, and the first detection unit is further configured to detect the first atomizer according to the first test signal; and the second detection unit is configured to turn on the second atomizer according to the operation action of the user, and output the second connection signal, and the second detection unit is further configured to detect the second atomizer according to the second test signal;

wherein the first detection unit comprises a second resistor, a third resistor, a fourth resistor, a fifth resistor, a sixth resistor, a seventh resistor, an eighth resistor, and a bipolar junction transistor;

one end of the second resistor is connected to a base of the bipolar junction transistor, the other end of the second resistor is connected to the main control chip, and the other end of the second resistor configured to obtain the first test signal;

one end of the third resistor is connected to the base of the bipolar junction transistor, and the other end of the third resistor is connected to an emitter of the bipolar junction transistor;

one end of the fourth resistor is connected to a collector of the bipolar junction transistor, the other end of the fourth resistor is connected to one end of the fifth resistor, the other end of the fifth resistor is connected to a power supply, and the other end of the fourth resistor is configured to turn on the first atomizer according to the operation action of the user;

one end of the sixth resistor is connected to the other end of the fourth resistor, the other end of the sixth resistor is connected to the main control chip, and the other end of the sixth resistor configured to output the first connection signal to the main control chip; and one end of the seventh resistor is connected to the collector of the bipolar junction transistor, the other end of the seventh resistor is connected to the main control chip, one end of the eighth resistor is connected to the other end of the fourth resistor, and the other end of the eighth resistor is connected to the main control chip.

8. The atomizer control circuit of claim 7, wherein the touch module comprises a first resistor and a touch key, the touch key comprises a power terminal, a ground terminal, and a touch signal output terminal, one end of the first resistor is connected to the power terminal, the other end of the first resistor is connected to a power supply, the ground terminal is grounded, and the touch signal output terminal is connected to the main control module.

9. The atomizer control circuit of claim 7, wherein the first atomization module comprises a ninth resistor and a field effect transistor, one end of the ninth resistor is connected to a source of the field effect transistor, the other end of the ninth resistor is connected to a gate of the field effect transistor, a drain of the field effect transistor is connected to the first atomizer, and the gate of the field effect transistor is connected to the main control chip.

10. The atomizer control circuit of claim 9, wherein the main control chip is configured to, when the first atomizer is normal, control the field effect transistor to be turned on according to the trigger signal.

11. The atomizer control circuit of claim 8, wherein the touch key is further configured to generate a power on-off signal according to multiple consecutive touches of the user, and the main control module is further configured to perform child lock power off or on according to the power on-off signal.

* * * * *